US011160159B2

(12) United States Patent
Mandrillon et al.

(10) Patent No.: US 11,160,159 B2
(45) Date of Patent: Oct. 26, 2021

(54) SYNCHROCYCLOTRON FOR EXTRACTING BEAMS OF VARIOUS ENERGIES

(71) Applicant: Ion Beam Applications S.A., Louvain-la-Neuve (BE)

(72) Inventors: Jérôme Mandrillon, Louvain-la-Neuve (BE); Willem Kleeven, Louvain-la-Neuve (BE); Jarno Van De Walle, Louvain-la-Neuve (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 0 days.

(21) Appl. No.: 17/193,997

(22) Filed: Mar. 5, 2021

(65) Prior Publication Data

US 2021/0282257 A1 Sep. 9, 2021

(30) Foreign Application Priority Data

Mar. 6, 2020 (EP) ..... EP20161640

(51) Int. Cl.
*H05H 13/02* (2006.01)
*H05H 7/04* (2006.01)
*H05H 7/00* (2006.01)

(52) U.S. Cl.
CPC ..... *H05H 13/02* (2013.01); *H05H 7/001* (2013.01); *H05H 7/04* (2013.01);
(Continued)

(58) Field of Classification Search
CPC ..... H05H 13/02; H05H 7/001; H05H 7/04; H05H 2007/045; H05H 2007/043; H05H 2007/002
See application file for complete search history.

(56) References Cited

U.S. PATENT DOCUMENTS 8,581,525 B2 3/2013 Antaya et al.
2013/0141019 A1* 6/2013 Kleeven ..... H05H 13/00 315/502

(Continued)

FOREIGN PATENT DOCUMENTS

CN 206 061 269 3/2017
EP 2446718 B1 3/2018

(Continued)

OTHER PUBLICATIONS

Kleeven, W. et al. "The IBA Superconducting Synchrocyclotron Project S2C2," *Proceedings of Cyclotron* 2013 (Mar. 1, 2014), pp. 115-119.

(Continued)

*Primary Examiner* — David A Vanore
(74) *Attorney, Agent, or Firm* — Finnegan, Henderson, Farabow, Garrett & Dunner LLP

(57) ABSTRACT

A synchrocyclotron for extracting charged particles accelerated to an extraction energy includes a magnetic unit comprising N valley sectors and N hill sectors, and configured for creating z-component of a main magnetic characterized by a radial tune of the successive orbits. The synchrocyclotron includes a first instability coil unit and a second instability coil unit configured for creating a field bump of amplitude increasing radially. The amplitude of the field bump may be varied to reach the value of the offset amplitude at the average instability onset radius. The offset amplitude may be the minimal amplitude of the field bump at the average instability onset radius required for sufficiently offsetting the center of the orbit of average instability onset radius to generate a resonance instability to extract the beam of charged particle at the average instability onset radius.

20 Claims, 3 Drawing Sheets

(52) U.S. Cl.
CPC . *H05H 2007/002* (2013.01); *H05H 2007/043* (2013.01); *H05H 2007/045* (2013.01)

(56) References Cited

U.S. PATENT DOCUMENTS

| | | | | |
|---|---|---|---|---|
| 2016/0143124 | A1* | 5/2016 | Kleeven | H05H 7/08 315/502 |
| 2017/0332475 | A1* | 11/2017 | Kleeven | H05H 7/10 |
| 2018/0132342 | A1* | 5/2018 | Abs | H05H 7/02 |
| 2020/0170099 | A1* | 5/2020 | Abs | G21K 1/093 |

FOREIGN PATENT DOCUMENTS

| | | |
|---|---|---|
| EP | 3503693 | 6/2019 |
| WO | WO 2013/098089 | 7/2013 |
| WO | WO 2020/044604 A1 | 3/2020 |

OTHER PUBLICATIONS

Wu, Xiaoyu "Conceptual Design and orbit Dynamics in a 250 MeV Superconducting Synchrocyclotron, Chapter 3: Extraction System Design," Dissertation submitted to Michigan State University (Jan. 1, 1990). Retrieved from https://d.lib.msu.edu/etd/22765/datastream/OBJ/View/.

Extended European Search Report issued in corresponding European Patent Application 20161640.6 dated Sep. 9, 2020.

* cited by examiner

E [MeV]
E2
E1

ν
1.00
0.99
0.98
νr
νz

Bz [T]
4
3
2

ΔBz(R) [T]
0.02
0.01
0.00
ΔBz0(R, νr)
ik
ij
ii
ii < ij < ik
52
51
R1
Rk
Rj
Ri
R2
R [m]

Bz [T]
4
3
N = 3
44h
44v
44h
44v
44h
44v
0
50
100
150
200
250
300
350
θ [deg]

SYNCHROCYCLOTRON FOR EXTRACTING BEAMS OF VARIOUS ENERGIES

CROSS-REFERENCE TO RELATED PATENT APPLICATIONS

This application is based upon and claims the benefit of prior European Patent Application No. 20161640.6, filed on Mar. 6, 2020, the entire contents of which are incorporated by reference herein.

TECHNICAL FIELD

The present disclosure concerns extraction of a beam of accelerated charged particles out of a synchrocyclotron (SC) comprising hill sectors and valley sectors alternatively distributed around the central axis (z) with a symmetry (N) of at least three, at different energies ranging between a low energy (E1) and a high energy (E2) corresponding to low and high average radii (R1, R2) of the trajectory followed by the beam. In particular, the extraction of the beam is triggered by a magnetic perturbation or field bump, having a magnitude which can be controlled over an azimuthal sector. of a given azimuthal angle (θc) (defining the aperture of the azimuthal sector) and comprised between the low and high average radii (R1, R2) to be equal to the offset amplitude ($\Delta Bz0(Ri, \nu r)\cdot\theta c/2\pi$) at the average instability onset radius (Ri) and at the radial tune (νr), wherein,

- Ri is the average instability onset radius where the beam is to be extracted, with $R1 \leq Ri \leq R2$, corresponding to a beam of energy (Ei),
- $\Delta Bz0(Ri, \nu r)\cdot\theta c/2\pi$ is the offset amplitude at the average radius (Ri), which depends on νr, and is the minimal amplitude of the magnetic perturbation at the average instability onset radius (Ri) required for sufficiently offsetting the centre of the orbit of average instability onset radius (Ri) to generate a resonance instability of the successive orbits of average radius, $R \geq Ri$.
- $\Delta Bz0(Ri, \nu r)$ is the maximum value of the bump amplitude at radius Ri.
- νr is the radial tune and is a measure of the betatron oscillations in the radial direction, and is controlled such that $\nu r \neq 1$, and $\nu r = 1 \pm 0.1$, $1 \pm 0.025$, or $1.002 \leq |\nu r| \leq 1.015$, to reduce the value of the offset amplitude ($\Delta Bz0(Ri, \nu r))\cdot\theta c/2\pi$.

The synchrocyclotron of the present invention is particularly advantageous in that it can extract beams of charged particles at a range of energies varying from 20% to 100% of the nominal energy of the synchrocyclotron. For example, for a 230 MeV synchrocyclotron, the present invention can very easily extract beams of charged particles of energies ranging from 46 MeV to 230 MeV

BACKGROUND

A cyclotron is a type of circular particle accelerator in which negatively or positively charged particles accelerate outwards from the center of the cyclotron along a spiral path forming successive concentric orbits up to energies of several MeV. The acceleration of the particles is driven by a radio frequency (RF)-alternating electric field, and the trajectory of the particles is guided along successively larger orbits on a plane (X, Y) of average radius (R) by the z-component (Bz) of a main magnetic field (B). There are various types of cyclotrons. In isochronous cyclotrons, both Bz and the frequency of the RF field are constant, so that the particle beam runs each successive cycle or cycle fraction of the spiral path in the same time. A synchrocyclotron is a special type of cyclotron, in which the frequency of the RF-alternating electric field varies to compensate for relativistic effects as the particles' velocity approaches the speed of light. This is in contrast to the isochronous cyclotrons, where this frequency is constant. Cyclotrons are used in various fields, for example in nuclear physics, in medical treatment such as proton-therapy, or in radio pharmacology.

The present disclosure concerns synchrocyclotrons. In a synchrocyclotron, the particles form longitudinal phase oscillations around a synchronous phase, typically of a few degrees to about 30 degrees, in such way that they are alternatively accelerated for a number of revolutions, then decelerated for another period of a number of revolutions. The resulting acceleration is slower in a synchrocyclotron than in an isochronous cyclotron, but due to the high longitudinal stability of the beam, many particles can be accelerated at each duty cycle.

A cyclotron comprises several elements including an injection unit, a RF accelerating system for accelerating the charged particles, a magnetic system for guiding the accelerated particles along a precise path, an extraction system for collecting the thus accelerated particles, and a vacuum system for creating and maintaining a vacuum in the cyclotron. Superconducting cyclotrons require a cryocooling system for maintaining the superconducting elements thereof at their superconducting temperatures.

An injection system introduces a particle beam with a relatively low initial velocity into an acceleration gap at or near the center of the cyclotron. The RF accelerating system sequentially and repetitively accelerates this particle beam, guided outwards along a spiral path within the acceleration gap by a magnetic field generated by the magnetic unit.

The magnetic unit generates a magnetic field that guides and focuses the beam of charged particles along the spiral path until reaching its target energy, Ei. The main magnetic field is generated in the gap defined between two field shaping units arranged parallel to one another on either side of a median plane (P) normal to the central axis (z) and defining a symmetry plane of the cyclotron, by two solenoid main coils wound around these field shaping units. The field shaping units can be magnet poles or superconducting coils separated from one another by the acceleration gap. The main magnetic field must be controlled to limit defocusing of the beam due to relativistic effects, inter alia.

Focusing can be improved by providing hill and valley sectors alternatively distributed around the central axis (z) with a symmetry (N) of at least three for shaping the main magnetic field with a symmetry of same order (N). The focusing and defocusing effects generated by radial and azimuthal components of the thus varying magnetic field near the median plane (P) affect the value of the tunes of the beam. The tunes of the beam are the fractions of periods each particle makes around a closed orbit during one revolution. At a given energy (Ei) (or at a given average radius (Ri)), tunes have a radial component (νr) and a normal component (νz). A perfectly flat main magnetic field (Bz) has a radial tune $\nu r=1$, resulting in an instable beam of charged particles. In a main magnetic field of tune $\nu r=1$, a not perfectly aligned particle would slip out of the orbit it is meant to follow and drift away, which must be avoided during the acceleration phase.

The main coils are enclosed within a flux return or yoke, which restricts the magnetic field within the cyclotron. Vacuum is extracted at least within the acceleration gap. Any one of the field shaping units and flux return can be made of magnetic materials, such as iron or low carbon steel, or can consist of coils activated by electrical energy. Said coils, as well as the main coils can be made of superconducting materials. In this case, the superconducting coils must be cooled below their critical temperature. Cryocoolers can be used to cool the superconducting components of a cyclotron below their critical temperature which can be of the order of between 2 and 10 K, typically around 4 K for low temperature superconductors (LTS) and of the order of between 20 and 75 K for high temperature superconductors (HTS). The flux return is provided with one or more exit ports for allowing the extraction of the charged particles out of the (synchro)cyclotron.

When the particle beam reaches its target energy, the extraction system extracts it from the cyclotron through an exit port and guides it towards an extraction channel. Several extraction systems exist and are known to a person of ordinary skill in the art, including stripping (mostly in isochronous cyclotrons), electrostatic extraction (also mostly in isochronous cyclotrons), and regenerative extraction, wherein a resonant perturbation is created by a field bump (possible in both synchrocyclotrons and isochronous cyclotrons).

Regenerative extraction creates a resonant perturbation in an orbit of a particle beam by applying a magnetic field bump (ΔBz). Iron bars with a well-defined azimuthal and radial extension (called "regenerator") are often used to generate a magnetic field bump. For example, U.S. Pat. No. 8,581,525 and WO2013098089 describe iron-based regenerators. A first drawback with iron-based regenerators includes that the magnitude of the magnetic field bump cannot be varied easily, and certainly not during operation of the cyclotron. This is a drawback when a same cyclotron is used to extract particles at different energies. A second drawback is that the energy of the extracted particle beam cannot be varied. If a particle beam of a given energy (Ei) is required for an application, the particle beam must be extracted at the nominal energy of the cyclotron, and the energy of the beam must be reduced by energy control devices located downstream of the exit port, outside of the synchrocyclotron, such as energy selection systems (ESS), degraders, range-shifters, collimators, and the like.

Iron-based regenerators can be replaced by coils, in particular by superconducting coils which can generate higher magnetic fields. The use of coils allows the magnitude, (ΔBz), of the field bump to be varied independently of the magnitude of the z-component (Bz) of the main magnetic field (B).

Solutions have been proposed for extracting a particle beam out of a synchrocyclotron at different energies (Ei) (or average radii (Ri)). U.S. Pat. No. 9,302,384 describes a synchrocyclotron comprising an extraction structure arranged proximate to the entry point of the extraction channel to change an energy level of the particles, wherein the extraction structure has multiple thicknesses and is movable relative to the extraction channel to place one of the multiple thicknesses in a path of the particles. This solution is not suitable for extracting beams of energies varying over a broad range [E1, E2].

WO2013142409 describes a synchrocyclotron comprising a series of magnetic extraction bumps extending in series radially from the central axis on opposite sides of the median acceleration plane. WO2017160758 describes a synchrocyclotron wherein an RF-frequency versus ion-time-of-flight scenario is set such that the frequency versus time scenario is the same for any ion extraction energy from the given design range, and a constant-or-variable-RF-voltage versus ion-time-of-flight scenario is adjusted to provide ion acceleration from injection to extraction for ions with different respective extraction energy levels within the given design range; and the ions are extracted at the different energy levels at the shared extraction radius. WO2019146211 describes a synchrocyclotron wherein a high-frequency wave of a different frequency from that of the high-frequency wave used for the acceleration is applied to the charged particle beam to eject the charged particle beam. Thus, in the circular accelerator that accelerates the charged particle beam while increasing the trajectory radius by applying the high-frequency wave within the main magnetic field, the ejection of the charged particle beam from the circular accelerator can thereby be controlled with high accuracy. These solutions require the intensity of the magnetic field or the frequency of the RF acceleration electric field to be varied, which requires time for large variations thereof.

US20190239333 describes a miniaturized and variable energy accelerator wherein a plurality of ring-shaped beam closed orbits of the trajectory of the particle beam followed by charged particles of corresponding energies, are offset on one side relative to the center of the synchrocyclotron. The frequency of the radiofrequency electric field fed to the charged particles by the acceleration electrode is modulated by the beam closed orbits. The offset of the orbits thus generated forms aggregated regions where adjacent orbits are very close to one another and discrete regions where adjacent orbits are separated by a larger distance in the radial direction.

US20150084548 describes a synchrocyclotron comprising an electrode that applies an RF electric field to accelerate the charged particle beam; and further comprising a DC power supply device that applies a DC electric field to the electrode. When the charged particle beam is accelerated while applying a DC voltage to the dummy dee electrode from outside a radius re. an E×B drift is generated along the spiral-shaped orbit to the radius re by the beam bending magnetic field B and the electric field E from the DC voltage Vdc at the outer side from re, the beam orbit drifts from the center to the outer side, and the charged particle beam is extracted by an electrostatic deflector electrode.

The solution proposed in the latter two documents is challenging for extracting charged particles at low energies, of the order of 25 to 50% of the nominal energy (Em) of the synchrocyclotron.

There therefore remains a need for a synchrocyclotron capable of delivering beams with fast variable energy having simplified and easy beam extraction, in that the energies may be switched rapidly with high dose rates. The present disclosure proposes a synchrocyclotron provided with a first and second instability coil units configured for creating a magnetic field bump of varying magnitudes for selecting the energy of the particles to be extracted. The perturbation thus created enters into resonance due to the specific magnetic field conditions the perturbed orbits are exposed to. The synchrocyclotron of the present disclosure fulfils the foregoing requirements. The following sections describe these and other advantages in more details.

SUMMARY

The present disclosure concerns a synchrocyclotron for extracting charged particles such as hadrons (e.g., protons), accelerated to an extraction energy (Ei) between a low energy (E1) and a high energy (E2). The synchrocyclotron comprises:

At least a first main coil and second main coil centred on a common central axis (z) arranged parallel to one another on either side of a median plane normal to the central axis (z) and defining a symmetry plane of the cyclotron, said at least first and second main coils being configured for generating a main magnetic field (B) when activated by a source of electric power, a dee configured for creating an RF-oscillating electric field of varying frequencies for accelerating the charged particles, a first field shaping unit and second field shaping unit (42) for shaping the main magnetic field (B) and thus guiding the charged particles along successive orbits of increasing average radii (R) centred on the central axis (z), the first and second field shaping units being arranged within the first and second main coils on either side of the median plane (P) and separated from one another by a gap, wherein the first and second field shaping units comprise hill sectors and valley sectors alternatively distributed around the central axis (z) with a symmetry (N) of at least three, for shaping the main magnetic field with a symmetry of same order (N), and a first instability coil unit and a second instability coil unit arranged on either side of the median plane, and configured for creating, when activated by a source of electric power, a field bump which is localized, in the z-component (Bz) of the main magnetic field.

In some embodiments, the hill sectors and valley sectors may have a symmetry (N) of $N=2n+1$ with $n \in N$. For example, N may be equal to 3. The z-component (Bz) of the main magnetic field may be controlled such that the radial tune ($\nu r$) of the successive orbits is not equal to 1 and is comprised within $1 \pm 0.1$, or, in alterative embodiments, within $1 \pm 0.025$ or $1.002 \leq |\nu r| \leq 1.015$, for all values of the average radius (R), comprised between a low radius (R1) and a high radius (R2), corresponding to respective average radial positions of the charged particles at the low and high energies (E1, E2).

The first and second instability coil units may be configured for creating the field bump within an azimuthal sector of azimuthal angle ($\theta c$), with an amplitude ($\Delta Bz(R)$) increasing radially, and in some embodiments monotonically, between a first field bump amplitude value ($\Delta Bz(R1)$) at the low radius (R1) and a second field bump amplitude value ($\Delta Bz(R2)$) at the high radius (R2).

The synchrocyclotron may also comprise a controlling unit configured for adjusting the amplitude ($\Delta Bz(R)$) of the field bump at various levels comprised between low values and high values, such that, for all values of an average instability onset radius (Ri) comprised between the low and high radii (R1, R2), the value of the amplitude of the field bump ($\Delta Bz(Ri)$) at the average instability onset radius (Ri), is equal to a value of an offset amplitude ($\Delta Bz0(Ri, \nu r)$) at the average instability onset radius (Ri), and is lower than the values of the offset amplitude ($\Delta Bz0(R, \nu r)$) for all values of the average radius (R) smaller than the average instability onset radius (Ri), wherein the offset amplitude ($\Delta Bz0(Ri, \nu r) \cdot \theta c/2\pi$) is the minimal amplitude of the field bump at the average instability onset radius (Ri) required for sufficiently offsetting the center of the orbit of average instability onset radius (Ri) along which the charged particles are guided, such that a combination of an amplitude of the harmonic 2 and a radial gradient of the amplitude of the harmonic 2 on this orbit is produced by the main magnetic field (B) of symmetry (N) on a thus offset orbit, and is large enough to generate a resonance instability of the successive orbits of average radius, $R \geq Ri$.

The first and second instability coil units may be defined such that a projection of the first and second instability coil units are located within an area defined circumferentially by an azimuthal section comprised within the azimuthal angle ($\theta c$) which can be smaller than $\pi/3$, or, in alternative embodiments, smaller than $\pi/4$, or smaller than $\pi/6$. Further, the area may be defined radially between the low and high radii (R1, R2).

In an embodiment, the first and second instability coil units can be in the form of a pair of trapezoidal or triangular coils of dimensions fitting the azimuthal sector of azimuthal angle ($\theta c$) and of length at least equal to (R2−R1) in the radial direction. The distance separating the first and second instability coil units can decrease radially, so that the amplitude ($\Delta Bz(R1)$) at the low radius (R1) is smaller than the amplitude ($\Delta Bz(R2)$) at the high radius (R2). The distance separating the first and second instability coil units may decrease linearly along the radial direction, wherein each of the first and second instability coil unit forms an angle with the median plane (P) comprised between 5 and 30 degrees, or, in alternative embodiments, between 10 and 25 deg.

In an embodiment, the first and second instability coil units may be formed by a series of two or more pairs of coils radially aligned within the azimuthal sector, each pair of coils being configured for generating a field bump of amplitude ($\Delta Bz(R)$) higher than the adjacent pair of coils located closer to the central axis (z), or of amplitude ($\Delta Bz(R)$) lower than the adjacent pair of coils located further away from the central axis (z).

The offset amplitude ($\Delta Bz0(Ri, \nu r) \cdot \theta c/2\pi$) at the average instability onset radius (Ri) may be defined such that $\Delta Bz0(Ri, \nu r) \cdot \theta c/2\pi$ is between 0.001% and 1% of an average value of the z-component (Bz) of the main magnetic field (B) at the average instability onset radius (Ri), or, in alternative embodiments, between 0.005% and 0.05% thereof.

For a synchrocyclotron having a nominal energy (Em) of extraction, the low energy (E1) may be comprised between 20% and 75% of Em, or, in alternative embodiments, between 30% and 50% of Em. The high energy (E2) can be comprised between 80% and 100% of Em, or between 90% or 95% and 99% of Em, The present disclosure also concerns a method for extracting charged particles out of a synchrocyclotron at any given value of an extraction energy (Ei) between a low energy (E1) and a high energy (E2). The method comprises the steps of:

providing a synchrocyclotron, configured such that the charged particles reach the extraction energy (Ei) at a corresponding average instability onset radius (Ri) of the orbit thereof, comprised between a low radius (R1) and a high radius (R2), corresponding to respective average radial positions relative to the central axis (z) of the charged particles at the low and high energies (E1, E2), and that a radial tune ($\nu r(R)$) of the successive orbits is not equal to 1 and is comprised within $1 \pm 0.1$, for all values of the average radius comprised between the low and high radii (R1, R2), selecting a value of the extraction energy (Ei) of the charged particles to be extracted, determining a value of the offset amplitude ($\Delta Bz0(Ri, \nu r)) \cdot \theta c/2\pi$ required for offsetting the center of the orbit of average radius (Ri) of the charged particles at the extraction energy (Ei), and thus generating a resonance instability of the successive orbits of average radius, $R \geq Ri$, adjusting the magnitude of the field bump such that the amplitude ($\Delta Bz(Ri)) \cdot \theta c/2\pi$ of the field bump equals the offset amplitude ($\Delta Bz0(Ri, \nu r)) \cdot \theta c/2\pi$ at the average instability onset radius (Ri) and is lower than the offset amplitude $(\Delta Bz0(R, \nu r))\cdot\theta c/2\pi$ for all values of the average radius smaller than the average radius (Ri), and extracting the beam form the synchrocyclotron through an exit port.

In some embodiments, the radial tune of successive orbits may be within $1\pm0.025$, or $1.002\leq|\nu r|\leq1.015$,

BRIEF DESCRIPTION OF THE FIGURES

For a fuller understanding of the nature of the present disclosure, reference is made to the following detailed description taken in conjunction with the accompanying drawings in which.

DETAILED DESCRIPTION

Figures 5A, 5B, 5C, 5D, 5E:
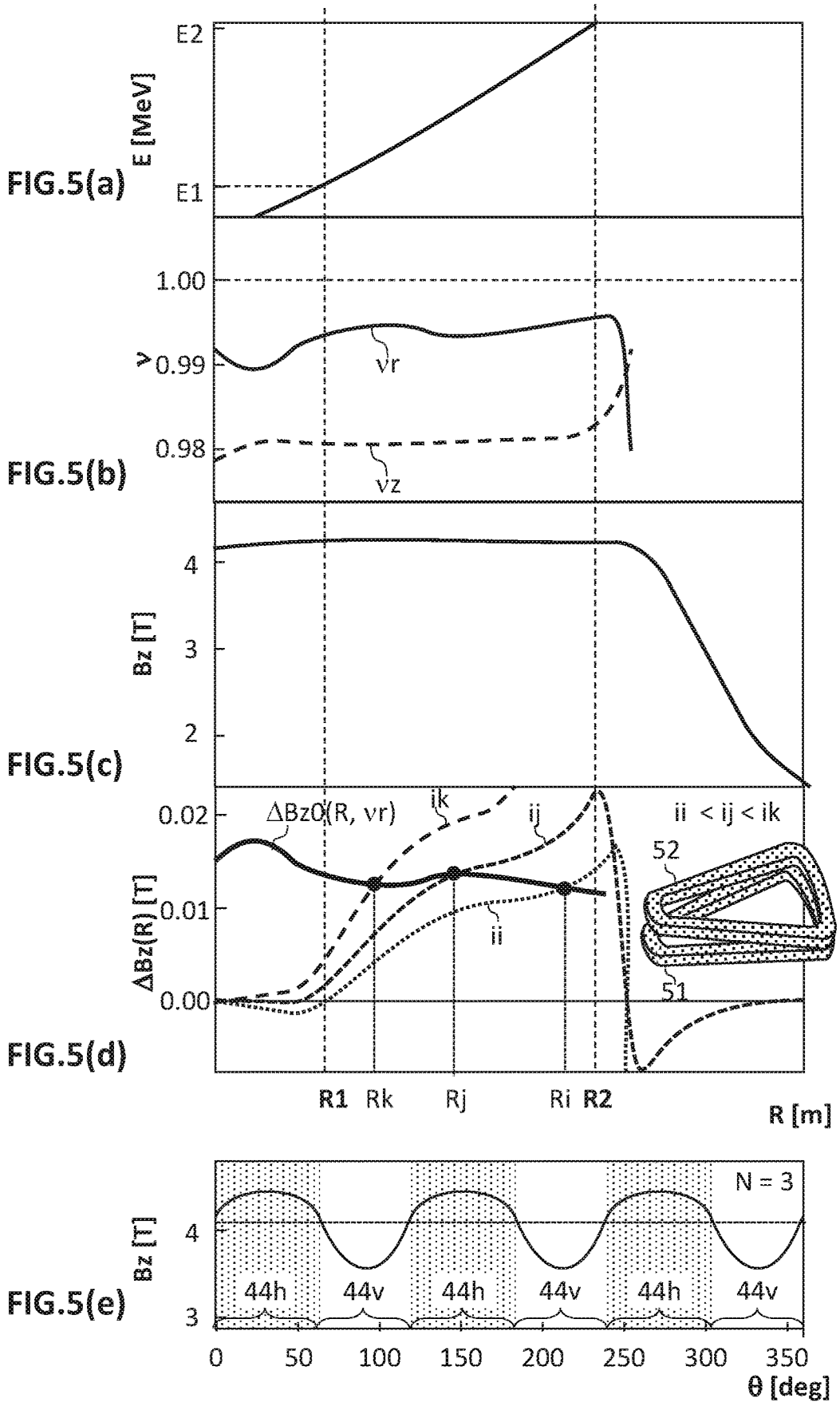
FIGS. 5(*a*)-5(*e*) show plots of (a) particles energy (E); (b) radial and normal tunes ($\nu r$, $\nu z$); (c) mean value over a full orbit of the z-component of the main magnetic field (Bz); (d) offset amplitude ($\Delta Bz0(R, \nu r)$), all of the foregoing as a function of the radial position of the particle beam (R); and (e) z-component of the main magnetic field (Bz) as a function of the azimuthal position (angle $\theta$) at a given radius (Ri).

The present disclosure concerns accelerated particle beam extraction systems applied to synchrocyclotrons producing beams of charged particles such as hadrons and, in particular, protons having a maximal or nominal target energy (Em). The nominal target energy (Em) of the particle beam may be of the order of 15 to 400 MeV/nucleon. In alternative embodiments, the nominal target energy may be between 60 and 350 MeV/nucleon, or between 70 and 300 MeV/nucleon. The nominal energy (Em) of a synchrocyclotron may be set when designing the synchrocyclotron. The synchrocyclotron (1) of the present disclosure is capable of extracting beams of charged particles at varying energies comprised between a low energy (E1) and a high energy (E2) of extraction, wherein $E1<Em\leq E2$. The low energy (E1) may be of the order of between 20% and 75% of Em or between 30% and 50% of Em, and wherein the high energy (E2) may be between 80% and 100% of Em or between 90% or 95% and 99% of Em. A beam of charged particles has a given energy (Ei) when it rotates at a corresponding orbit of radius (Ri), as illustrated in FIG. 5(*a*). The orbits followed by a beam of charged particles are herein characterized by an "average radius" because the orbits are not circular due to the valley and hill sectors (44*v*, 44*h*) and corresponding azimuthal variations of Bz. The average radius of an orbit is the mean value of the radii of the orbit over a whole revolution (i.e., 360 degrees.).

The extraction at varying energies by the synchrocyclotron of the present disclosure is made possible by, on the one hand, creating a field bump which amplitude ($\Delta Bz(Ri)$) at any orbit of average radius (Ri) comprised between R1 and R2 can be varied to reach the value of the offset amplitude ($\Delta Bz0(Ri, \nu r)$) required for offsetting the center of the orbit of average radius (Ri) sufficiently for creating a resonant instability and, on the other hand, by creating the conditions for the offset amplitude ($\Delta Bz0(R, \nu r)$) to be sufficiently high to allow a stable and reproducible acceleration of the beam and sufficiently low to limit the magnitude ($\Delta Bz(Ri)$) of the field bump. The foregoing features can be combined in a synchrocyclotron according to the present disclosure as explained below. Additionally, the beam may be extracted at the maximum target energy (Em).

The present invention can be implemented on conventional synchrocyclotrons. A synchrocyclotron according to the present disclosure includes the following components.

A dee (21) configured for creating an RF-oscillating electric field for accelerating the charged particles. The frequency varies along the path of the charged particles to take account of relativistic effects as the velocity of the particles approaches light speed.

A magnetic unit comprising main coils for creating a main magnetic field (B) and field shaping units for shaping the main magnetic field (B), in particular, the z-component (Bz) of the main magnetic field. The z-component (Bz) of the main magnetic field is used for bending the trajectory of the accelerating particles along a spiral trajectory formed by a series of successively larger concentric orbits of radius (Ri).

An extraction unit for extracting the beam of charged particles which have reached a target energy. The synchrocyclotron may differ from conventional synchrocyclotrons in that it belongs to a family of synchrocyclotrons wherein the target energy can be varied over a broad range comprised between a low and high energies (E1, E2).

Figure 2:
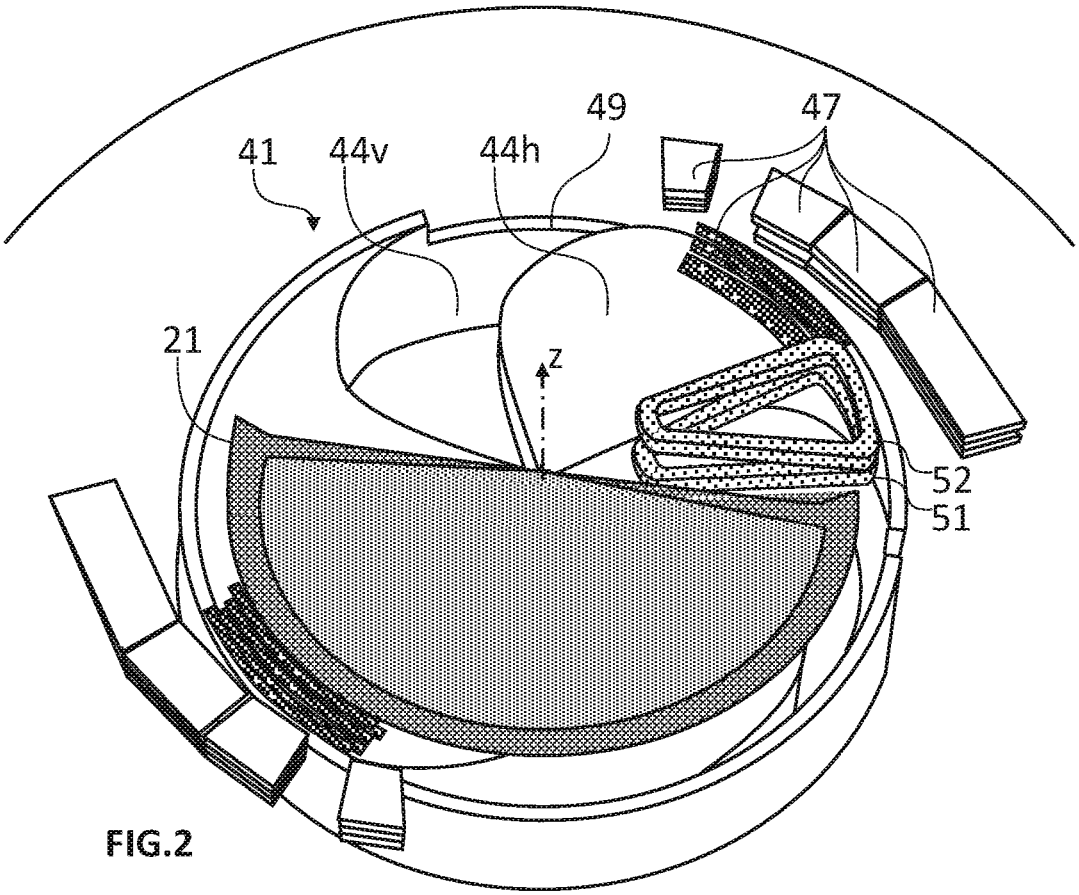
FIG. 2 shows a perspective view of an embodiment of a synchrocyclotron according to the present disclosure with the second field shaping unit removed to show the interior of the synchrocyclotron.

As illustrated in FIG. 2, the synchrocyclotron of the present disclosure comprises a dee (21) generally made of a D-shaped hollow sheet of metal for creating an RF-oscillating electric field. The other pole is open. The frequency of oscillating electric field decreases continuously to account for the increasing mass of the accelerating charged particles reaching relativistic velocities. One terminal of the oscillating electric potential varying periodically is applied to the dee and the other terminal is on ground potential.

Figure 1:
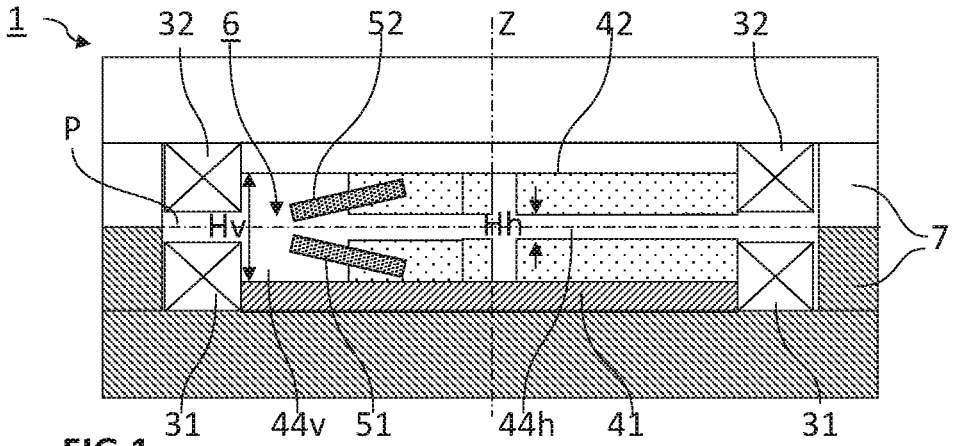
FIG. 1 shows a side cut view of an embodiment of a synchrocyclotron according to the present disclosure with magnet poles and first and second instability coil units, illustrated without a dee.

The synchrocyclotron further comprises a magnetic unit comprising main coils (31, 32) and field shaping units (41, 42) for bending into concentrically larger orbits (=spiral) the trajectory of the beam of charged particles as it is being accelerated by the RF-oscillating electric field. As illustrated in FIG. 1, a synchrocyclotron comprises at least a first and second main coils (31, 32), which can be superconducting or not, centered on a common central axis (z), arranged parallel to one another on either side of a median plane (P) normal to the central axis (z). The median plane (P) defines a plane of symmetry of the synchrocyclotron. The first and second main coils generate a main magnetic field (B) when activated by a source of electric power. The main magnetic field is used to bend the trajectory of the charged particles.

The magnetic unit also comprises a first field shaping unit (41) and a second field shaping unit (42). The first and second field shaping units (41, 42) are arranged within the first and second main coils on either side of the median plane (P) and are separated from one another by a gap (6). The orbits of the beam of charged particles are comprised within or oscillate about the median plane. The first and second field shaping units (41, 42) may be in the form of magnet poles made of ferromagnetic metal (e.g., steel) or may be formed by a series of coils, such as superconducting coils. for shaping the main magnetic field (B) and thus guiding the charged particles along successive orbits of increasing average radii (R) (=spiral path) centered on the central axis (z). In particular, the first and second field shaping units (41,42) may be configured for controlling a z-component (Bz) of the main magnetic field between the first and second field shaping units, which is parallel to the central axis (z) such that the revolution speed of the particles around each orbit is synchronized with the RF-oscillating electric field, for all values of the radius (R) of the orbits. An example of z-component (Bz) of the main magnetic field is illustrated in FIG. 5(*c*) in the radial direction, and in FIG. 5(*e*), as a function of the angular position (θ) at a given radius (Ri).

The first and second field shaping units (41, 42) comprise hill sectors (44*h*) and valley sectors (44*v*) alternatively distributed around the central axis (z) with a symmetry (N) of at least three. In some embodiments, N may be an odd number (N=2n+1, with n∈N) such as N=3, for shaping the z-component of the main magnetic field with a symmetry of same order (N), as shown in FIG. 5(*e*). The gap (6) may therefore have a height which varies with the angular position, with heights (Hv) measured between two valley sectors being larger than the heights (Hh) measured between two hill sectors (44*h*), as shown in FIG. 1.

Once the beam of charged particles has reached the target energy, it must be extracted from the synchrocyclotron. The synchrocyclotron of the present disclosure uses a novel regenerative device for creating an instability to a given orbit of radius (Ri) of the trajectory of the beam ranging between R1 and R2, which enters into resonance as will be explained below. The synchrocyclotron comprises first and second instability coil units (51, 52), each comprising at least a coil which can be energized to create an instability to a given orbit. Once the charged particles of the beam reach a region of the gap where they are not bent by the main magnetic field to remain within the gap (i.e., a stray field region), the beam can be extracted through one or more exit ports (49). Since the main magnetic field is lower in the valleys than in the hills (cf. FIG. 5(*e*)), the extraction path may follow a valley sector (44*v*). The field shaping units may be shaped such that a beam which has entered into resonance instability along the median plane (P) preserves a sufficient stability in the z-direction, to avoid losing control over too many charged particles.

As shown in FIG. 2, iron bars (47) or coils may be arranged to guide the beam out of the gap, through the exit port (49) and out of the synchrocyclotron.

Thus, the extraction system may combine:

(a) control of the main magnetic field to maintain the orbits close to but within the limits of stability, as a function of the value of the radial tune, νr, (b) first and second instability coil units (51, 52) for creating a field bump having a specific profile to offset an orbit of selected radius (Ri) among any radius comprised between R1 and R2, and (c) a symmetry (N>2) of the z-component (Bz) of the main magnetic field to bring the instability of the orbit into resonance and drive the beam out of the gap (6) and out of the synchrocyclotron.

The radial tune is a measure of the oscillations in the radial direction of the beam over the orbits forming its trajectory. In other words, a tune is the ratio of oscillations to revolutions of the beam. At a given energy, tunes are defined in both transverse direction to the trajectory of the beam: the radial tune (νr) in the radial direction and the normal tune (νz) normal to the median plane (P). A perfectly flat magnetic field in the radial direction has a radial tune, νr=1, and is unstable, in that particles which are not perfectly aligned on a closed orbit would slip out of the orbit along the median plane and drift in a given direction. Such drift must be avoided or at least minimized at least during the acceleration phase of the beam, before reaching the target energy. By design, in isochronous cyclotrons, νr>1 and cannot be selected very close to unity, as in such conditions the field could not increase sufficiently with the radius to compensate relativistic effects at high energies. This is not the case with synchrocyclotron since there is no isochronism conditions imposed when designing the magnetic field.

In the present disclosure, the radial tune (νr) of the successive orbits comprised between the low average radius (R1) and the high average radius (R2), is not equal to 1 as the beam would be too unstable to be accelerated along the orbits. The radial tune (νr) may be comprised within 1±0.1, or within 1±0.025, such as $1.002 \leq |\nu r| \leq 1.015$. The radial tune (νr) may be excluded from the range, $|1-\nu r|<0.002$, to give the beam sufficient stability to reach the target energy. For instance, the beam may have sufficient stability to reach the target energy when $0.002 \leq |1-\nu r| \leq 0.015$ or $0.004 \leq |1-\nu r| \leq 0.012$. An example of the radial tune (νr) (solid line) as a function of the radius (R) is illustrated in FIG. 5(*b*); the normal tune (νz) is also illustrated as a dashed line in FIG. 5(*b*).

Selecting the radial tune (νr) within the foregoing ranges ensures, on the one hand, that it is sufficiently high for all the orbits of average radius comprised between (R1) and (R2) which is smaller than the average instability onset radius to be sufficiently stable to accelerate the beam to the target energy and, on the other hand, that it is sufficiently low to require only a small perturbation, either electric or magnetic, to offset the orbits. In the present disclosure, a magnetic perturbation is used. This is may initiate a resonant process leading to the extraction of the beam.

Figure 3:
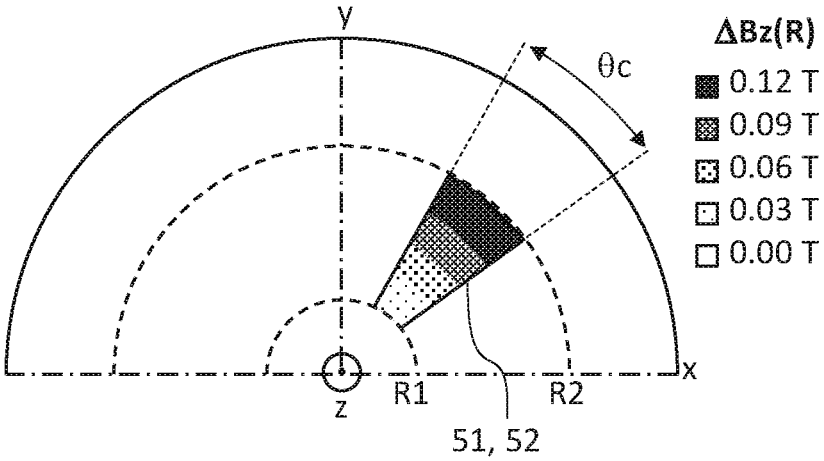
FIG. 3 shows a top view of an example of location and intensity of the field bump created by the first and second instability coil units.

With the values of the radial tune (νr) as discussed supra, a small magnetic perturbation suffices to offset an orbit of given radius (Ri) comprised between R1 and R2. The magnetic perturbation is created by a first instability coil unit (51) and a second instability coil unit (52) arranged on either side of the median plane (P) as shown in FIGS. 1 and 2. As illustrated in FIGS. 3 and 5(*c*), the first and second instability coil units (51,52) are configured for creating, when activated by a source of electric power, a field bump which is localized, in the z-component (Bz) of the main magnetic field, As shown in FIG. 5(*d*), the first and second instability coil units (51, 52) are configured for creating the field bump with an amplitude (ΔBz(R)) having a profile which increases radially, and in some embodiments monotonically, between a first field bump amplitude value (ΔBz(R1)) at the low radius (R1) and a second field bump amplitude value (ΔBz (R2)) at the high radius (R2).

A controlling unit is configured for adjusting the amplitude (ΔBz(R)) of the profile of the field bump at various levels comprised between low values and high values, such that, the value of the amplitude (ΔBz(Ri)) at any average radius (Ri) comprised between R1 and R2 can be varied up and down within a given range. For example, the amplitude of the field bump can be increased from the low values (ΔBz(R1)) to the high values (ΔBz(R2)) by scaling or by shifting up the amplitude of the field bump, or combination thereof. This can be done by simply varying the amount of current fed to the first and second instability coils (51, 52).

The values of the offset amplitude ($\Delta Bz0(Ri, \nu r)\cdot\theta c/2\pi$) at any average instability onset radius (Ri) comprised between (R1) and (R2) may be determined and entered into the controlling unit. The offset amplitude ($\Delta Bz0(Ri, \nu r)\cdot\theta c/2\pi$) is the minimal amplitude of the field bump at the average instability onset radius (Ri) required for sufficiently offsetting the center of the orbit of average instability onset radius (Ri) along which the charged particles are guided. The offset must be sufficient for producing a combination of harmonic 2 and gradient of harmonic 2 on this orbit by the main magnetic field (B) of symmetry (N) on a thus offset orbit. This combination must be large enough to generate a resonance instability of the successive orbits of average radius, $R \geq Ri$. Knowing the values of the main parameters of the synchrocyclotron, including the radial tune ($\nu r$), the z-component of the main magnetic field (Bz), the degree of symmetry (N), and the like, a person skilled in the art may determine the offset amplitude for any value of the average radius (R) when designing the synchrocyclotron. An example of the offset amplitude ($\Delta Bz0(R, \nu r)$) is schematically represented with the thick continuous line of FIG. 5(*d*) as a function of R, and for the values of the radial tune as illustrated e.g., in FIG. 5(*b*).

Referring to FIG. 5(*d*), an orbit of average radius (Ri) (referred to as the average instability onset radius) followed by a beam of charged particles of energy (Ei) can be offset relative to the center of the synchrocyclotron by setting the amplitude ($\Delta Bz(Ri)$) of the field bump to be equal to the value of the offset amplitude ($\Delta Bz0(Ri, \nu r)$) at the average instability onset radius (Ri) and, at the same time, ensuring that the amplitude ($\Delta Bz(Ri)$) of the field bump is lower than the values of the offset amplitude ($\Delta Bz0(R, \nu r)$) for all values of the average radius (R) smaller than the average instability onset radius (Ri). In other terms, for a given azimuthal sector and hence for a given value of $\theta c/2\pi$, $\Delta Bz(Ri)=\Delta Bz0(Ri, \nu r)$, and $\Delta Bz(Rk)<\Delta Bz0(Rk, \nu r)$, $\forall Rk<Ri$. This is represented with the dotted curve (ii) in FIG. 5(*d*). This may ensure that the orbits of average radius $Rk<Ri$ followed by the charged particles remain stable in spite of the perturbation of amplitude ($\Delta Bz(Rk)$) because $\Delta Bz(Rk)<\Delta Bz0(Rk, \nu r)$ (as shown in FIG. 5(*d*), where the field bump profile (ii) (=dotted line) is below the curve $\Delta Bz0(R, \nu r)$ (thick solid line), for all values below Ri). The amplitude ($\Delta Bz(R)$) of the field bump at radii, $R>Ri$ can be larger than the offset amplitude ($\Delta Bz0(Ri, \nu r)$), since by offsetting the orbit of average instability onset radius (Ri), the beam does not follow the same trajectory for orbits of larger radii as in the absence of a field bump.

If a different orbit of average instability onset radius (Rj) or (Rk) is to be offset for extraction of a beam of energy (Ej) or (Ek), the amplitude ($\Delta Bz(Rj)$) or ($\Delta Bz(Rk)$) of the field bump is set as follows, $\Delta Bz(Rj)=\Delta Bz0(Rj, \nu r)$, and $\Delta Bz(R)<\Delta Bz0(Rj, \nu r)$, $\forall R<Rj$, as illustrated with the short dashed line (ij) in FIG. 5(*d*), or $\Delta Bz(Rk)=\Delta Bz0(Rk, \nu r)$, and $\Delta Bz(R)<\Delta Bz0(Rk, \nu r)$, $\forall R<Rk$, as illustrated with the long dashed line (ik) in FIG. 5(*d*).

The values of the offset amplitude ($\Delta Bz0(Ri, \nu r)$. $\theta c/2\pi$) at any average instability onset radius (Ri) comprised between (R1) and (R2) may be of the order of 0.001% to 1% of an average value of the z-component (Bz) of the main magnetic field at the average instability onset radius (Ri), such as 0.002% to 0.7%. In alternative embodiments, the offset amplitude may be 0.005% to 0.05% or 0.021%±0.02% of Bz(Ri). For example, for a z-component (Bz) of the main magnetic field of the order of 4 T at an average instability onset radius (Ri), the offset amplitude ($\Delta Bz0(Ri, \nu r)\cdot\theta c/2\pi$) may be of the order of 0.025 T±0.02 T, depending on the values of the radial tune ($\nu r(Ri)$) at the average instability onset radius (Ri).

An orbit of average instability onset radius (Ri) can be offset relative to the center of the synchrocyclotron as described herein. The offset of the orbit thus created may be taken advantage of by generating a resonance instability in the orbit that drifts the following orbits. The "following orbits" are defined herein as the orbits of average radii equal to or larger than the average instability onset radius (Ri). A condition for creating resonance is generally accepted that $k\,\nu r+l\,\nu z=m$, with $k, l, m\in N$. For example, $l=0$ and $k=m=2$, yielding $2\,\nu r=2$, may be used for extracting a beam driven by a combination of an amplitude of the harmonic 2 and a radial gradient of the amplitude of the harmonic 2 in the magnetic field. This may be generated in synchrocyclotrons by sets of iron bars or coils called a peeler-regenerator system.

In the present disclosure, once the orbit of average instability onset radius (Ri) has been offset relative to the central axis (z), the following orbits are exposed to a main magnetic field which z-component (Bz) has a symmetry (N) relative to the central axis (z) as illustrated in FIG. 5(*e*) for N=3. This symmetry is, however, not relative to the offset centers of the following orbits. The exposition of the beam to the main magnetic field of offset symmetry (N) relative to the orbits of average radii equal to or greater than (Ri) (i.e., the following orbits) creates a combination of harmonic 2 and gradient of harmonic 2 on the following orbits. The combination of harmonic 2 and gradient of harmonic 2 may be dimensioned to generate a resonance instability of the successive orbits of average radius, $R\geq Ri$.

The symmetry (N) of the first and second filed shaping units (41, 42) may be configured to preserve the vertical stability (in the z-direction) of the beam as the centers of following orbits drift away from the central axis (z). The field bump magnitude ($\Delta Bz(Ri)$) may generate a sufficient offset for the drifting following orbits to generate a strong $2^{nd}$ harmonic component in the following orbits. The symmetry (N) of the first and second field shaping units may be an odd number ($N=2n+1$, with $n\in N$), as it facilitates the formation of a resonance harmonic 2 in the orbits. A $2^{nd}$ harmonic component may be generated in the following orbits with a symmetry (N) wherein N is an even number ($N=2n$, with $n>1$ and $n\in N$) with a field bump having a slightly higher amplitude ($\Delta Bz(Ri)$) than with an odd symmetry ($N=2n+1$). In some embodiments, N may be equal to 3 (i.e., N=3).

The separation between the following orbits increases with the number of revolutions during which the unstable drift lasts before extraction. For example, the unstable drift of the following orbits may last at least 5 revolutions, at least 10 revolutions, or at least 20 revolutions, to build up sufficient separation between successive orbits to yield larger offset in angle and position between energies when the orbits reach the stray field of the field shaping units.

A field bump defined within an azimuthal sector of relative angle ($\theta c/2\pi$) and having a magnitude $\Delta Bz(Ri)=\Delta Bz0(Ri, \nu r)$, at any orbit of average radius (Ri) comprised between the low radius (R1) and the high radius (R2) and, at the same time, $\Delta Bz(Rk)<\Delta Bz0(Rk, \nu r)$, $V\,Rk<Ri$, may be formed by first and second instability coil units (51, 52) extending radially at least between the low and high radii (R1, R2). As illustrated in FIG. 3 showing a projection onto the median plane (P) of the first and second instability coil units (51, 52), the first and second instability coil units (51,52) may be located at least partially within an area defined circumferentially by an azimuthal sector comprised within a given azimuthal angle (θc) smaller than π/3 rad (i.e., θc<π/3), e.g., smaller than π/4 rad (i.e., θc<π/4) or smaller than π/6 rad (i.e., θc<π/6).

As illustrated in FIGS. 1, 2, and 5(*d*), the first and second instability coil units (51, 52) may be in the form of a pair of substantially trapezoidal or triangular coils of dimensions fitting the desired azimuthal sector of azimuthal angle (θc) and of length at least equal to (R2−R1) in the radial direction. A field bump of amplitude (ΔBz(R)·θc/2π) increasing radially may be formed by decreasing radially the distance separating the first and second instability coil units, so that the amplitude (ΔBz(R1)·θc/2π) at the low radius (R1) is smaller than the amplitude (ΔBz(R2)·θc/2π) at the high radius (R2). The distance separating the first and second instability coil units may decrease linearly, i.e., the first and second instability coil units have straight radial sections extending radially. For example, each of the first and second instability coil unit (51, 52) may form an angle with the median plane (P) comprised between 5 and 30 degrees, or, in alternative embodiments, between 10 and 25 degrees. Alternatively, the distance may decrease non-linearly, with curved radial sections.

Alternatively, the amplitude (ΔBz(R)·θc/2π) of the field bump may increase radially by aligning radially a series of two or more pairs of coils within the azimuthal sector, each configured for generating a field bump of amplitude (ΔBz (R)·θc/2π) higher than the adjacent pair of coils located closer to the central axis (z) or of amplitude (ΔBz(R)·θc/2π) lower than the adjacent pair of coils located further away from the central axis (z)

By using coils for creating a field bump, the amplitude profile (ΔBz(R)) of the field bump may be varied at various levels comprised between low values and high values by simply varying the amount of current fed to the coils. The whole profile of the amplitude of the field bump (ΔBz(R)) may be varied, for example, by scaling, by shifting up and down, or by a combination of both.

The first and second instability coil units (51, 52) may be located in a valley sector (44*v*). This has two main advantages. First, since the gap height (Hv) in a valley sector (44*v*) is larger than the gap height (Hh) in a hill sector (44*h*), there is more room for installing the first and second instability coil units (51, 52). Second, since the z-component (Bz) of the main magnetic field is lower in the valley sectors than in the hill sectors (cf. FIG. 5(*e*)), a field bump of lower amplitude (ΔBz(R)) is required for creating an instability sufficient for offsetting the orbit of average instability onset radius (Ri).

Figure 4A:
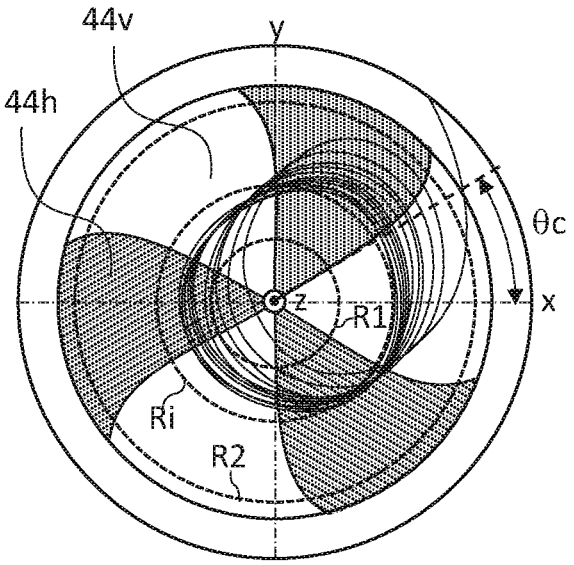
FIGS. 4(*a*) and 4(*b*) show two embodiments of trajectories after destabilization by the field bump (a) at orbits of low energy particles (close to R1), and (b) at orbits of high energy particles (close to R2).
Figure 4B:
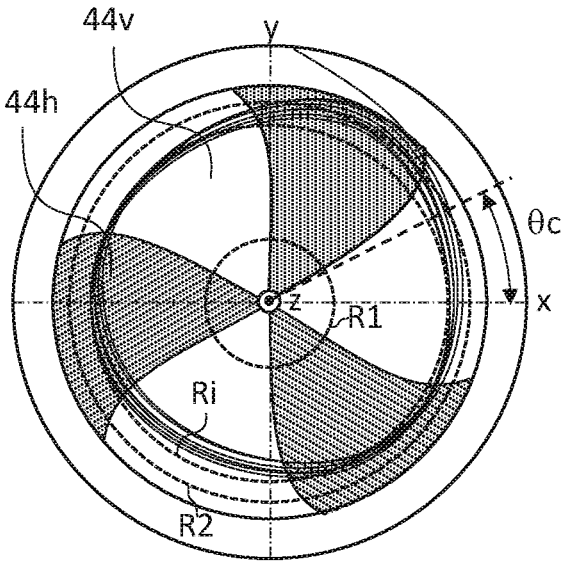

As illustrated in FIGS. 1, 2, 4(*a*), and 4(*b*), the instability in an orbit of average instability onset radius (Ri) (Ri is close to R1 in FIG. 4(*a*) and Ri is close to R2 in FIG. 4(*b*)), creates a drift of the following orbits, which enters into resonance as the beam accelerates in a magnetic field having a symmetry (N) offset relative to the centers of the following orbits. The drift of the orbits drives the beam towards a stray field at the edges of the field shaping units (41, 42) where it can be guided by a magnetic channel which can be formed by iron bars or coils (47) towards an exit port (49) through the yoke (7).

The angle and entry point of a beam into the stray field depends on the energy of the beam. By controlling the direction and building process of the drift of a beam, the angles and entry points of beams of different energies, albeit different, may be concentrated in a limited region, where a magnetic channel can drive the beams of different energies through a single exit port (49). Guiding beams of different energies entering the stray field at different positions and angles through a single exit port can be carried out by a skilled person, such as described e.g., in EP3503693.

The synchrocyclotron of the present disclosure is advantageous in that beams of widely varying energies between low and high energies (E1, E2) can be extracted by a simple tuning of the first and second instability coil units (51, 52) by a method comprising the following steps.

First, providing a synchrocyclotron as discussed supra configured, such that, the charged particles reach the extraction energy (Ei) at a corresponding average instability onset radius (Ri) of the orbit thereof, comprised between a low radius (R1) and a high radius (R2), corresponding to respective average radial positions relative to the central axis (z) of the charged particles at the low and high energies (E1, E2), and that the radial tune (νr(R)) of the successive orbits is not equal to 1 and is comprised within 1±0.1, for all values of the average radius comprised between the low and high radii (R1, R2), In some embodiments, the radial tune of successive orbits may be within 1±0.025, or 1.002≤|νr|≤1.015, Then selecting a value of the extraction energy (Ei) of the charged particles to be extracted, and determining the value of the offset amplitude (ΔBz0(Ri, νr)·θc/2π) required for offsetting the center of the orbit of average radius (Ri) of the charged particles at the extraction energy (Ei) such that a resonance instability of the successive orbits of average radius, R≥Ri, is generated. The present disclosure allows for adjustment of the amplitude of the field bump such that the amplitude (ΔBz(Ri)) of the field bump equals the offset amplitude (ΔBz0(Ri, νr)) at the average instability onset radius (Ri) and is lower than the offset amplitude (ΔBz0(R, νr)) for all values of the average radius smaller than the average radius (Ri). This may be performed by varying the amount of current fed to the first and second instability coil units (51, 52), such that the profile of the amplitude (ΔBz (R)) varies, for example by scaling, shifting up and down, or combination of the two.

The present disclosure is advantageous in that the tuning of the extraction energies is easy and quick to perform, and in that it is possible to equip existing synchrocyclotrons with a main magnetic field that may be adapted to yield the desired profile and radial tune (νr), with first and second instability coil units (51, 52) to perform the method of the present disclosure.

LIST OF REFERENCE NUMERALS

| Ref | Description |
|---|---|
| 1 | synchrocyclotron |
| 6 | Gap |
| 7 | Yoke |
| 31 | First main coil |
| 32 | Second main coil |
| 41 | First field shaping unit |
| 42 | Second field shaping unit |
| 44h | Hill sector |
| 44v | Valley sector |
| 47 | peeler-regenerator |
| 49 | Exit port |
| 51 | First instability coil unit |
| 52 | Second instability coil unit |
| B | Main magnetic field |
| Bz | z-component of main magnetic field |
| E1 | Low energy |

-continued

| LIST OF REFERENCE NUMERALS | |
|---|---|
| Ref | Description |
| E2 | High energy |
| Em | Maximal or nominal extraction energy |
| Hh | Hill height |
| Hv | Valley height |
| ii, ij, ik | Field bump profile intersecting ΔBz0(Ri, νr) at Ri, Rj, Rk |
| N | Main magnetic field symmetry |
| P | Median plane |
| R | Average radius of an orbit |
| R1 | Low (average) radius corresponding to an extraction low energy E1 |
| R2 | high (average) radius corresponding to an extraction high energy E2 |
| Ri, j, k | Average radii of orbits i, j, k |
| ΔBz(R) | Field bump amplitude |
| ΔBz0(R, νr) | Offset amplitude (curve) as a function of R |
| ΔBz0(Ri, νr) | Offset amplitude at average radius Ri |
| νr | Radial tune |
| θ | Azimuthal angle |
| θc | Azimuthal extent of the instability coil units |
| θc/2π | Relative angle of the azimuthal sector |

The invention claimed is:

1. A synchrocyclotron for extracting charged particles accelerated to an extraction energy comprised between a low energy and a high energy, the synchrocyclotron comprising:

a first main coil and second main coil centered on a common central axis and arranged parallel to one another on either side of a median plane normal to the central axis and defining a symmetry plane of the cyclotron, the first and second main coils being configured for generating a main magnetic field when activated by a source of electric power;

a dee configured for creating an RF-oscillating electric field of varying frequencies for accelerating the charged particles;

a first field shaping unit and second field shaping unit for shaping the main magnetic field and guiding the charged particles along successive orbits of increasing average radii centered on the central axis, the first and second field shaping units being arranged within the first and second main coils on either side of the median plane and separated from one another by a gap, wherein the first and second field shaping units comprise hill sectors and valley sectors alternatively distributed around the central axis with a symmetry of at least three for shaping the main magnetic field;

a first instability coil unit and a second instability coil unit arranged on either side of the median plane, the first and second instability coil units each comprising a coil configured for creating a field bump localized in a z-component of the main magnetic field; and a controlling unit configured for adjusting the amplitude of the field bump at various levels such that, for all values of an average instability onset radius between a low radius and a high radius, a value of the amplitude of the field bump at the average instability onset radius is equal to a value of an offset amplitude at the average instability onset radius, and lower than the values of the offset amplitude for all values of the average radius smaller than the average instability onset radius; wherein the z-component of the main magnetic field is controlled such that the radial tune of the successive orbits is not equal to 1 and is comprised within 1±0.1 for all values of an average radius between the low radius and the high radius, the low radius corresponding to average radial positions of the charged particles at the low energy and the high radius corresponding to average radial positions of the charged particles at the high energy;

the first and second instability coil units are configured for creating the field bump within an azimuthal sector of azimuthal angle, with an amplitude increasing radially between a first field bump amplitude value at the low radius and a second field bump amplitude value at the high radius; and the offset amplitude is a minimal amplitude of the field bump at the average instability onset radius required for sufficiently offsetting the center of an orbit of an average instability onset radius along which the charged particles are guided, such that a combination of an amplitude of the harmonic 2 and a radial gradient of the amplitude of the harmonic 2 on the orbit is produced by the main magnetic field of symmetry on an offset orbit, and the offset amplitude is large enough to generate a resonance instability of the successive orbits of average radius greater than R≥Ri.

2. The synchrocyclotron according to claim 1, wherein the first instability coil unit and the second instability coil unit are located within an area defined circumferentially by an azimuthal sector having an azimuthal angle smaller than π/3, and radially between the low radius and the high radius.

3. The synchrocyclotron according to claim 2, wherein the azimuthal angle is smaller than π/4.

4. The synchrocyclotron according to claim 2, wherein the azimuthal angle is smaller than π/6.

5. The synchrocyclotron according to claim 2, wherein the first instability coil unit and the second instability coil unit are in the form of a pair of trapezoidal or triangular coils of dimensions fitting the azimuthal sector and of length at least equal to a difference of the high radius and the low radius in the radial direction, wherein a distance separating the first instability coil unit and the second instability coil unit decrease radially so that a field bump amplitude at the low radius is smaller than a field bump amplitude at the high radius.

6. The synchrocyclotron according to claim 3, wherein the distance separating the first instability coil unit and the second instability coil unit decreases linearly along the radial direction, and wherein the first instability coil unit and the second instability coil unit form an angle with the median plane between 5 and 30 degrees.

7. The synchrocyclotron according to claim 6, wherein the first instability coil unit and the second instability coil unit form an angle with the median plane between 10 and 25 degrees.

8. The synchrocyclotron according to claim 2, wherein the first instability coil unit and the second instability coil unit are formed by a series of two or more pairs of coils radially aligned within the azimuthal sector, each pair of coils being configured for generating a field bump having an amplitude higher than an adjacent pair of coils located closer to the central axis, or generating a field bump having an amplitude lower than an adjacent pair of coils located further away from the central axis.

9. The synchrocyclotron according to claim 1, wherein for all values of the average instability onset radius between the low radius and the high radius, the offset amplitude at the average instability onset radius is defined such that the offset amplitude is between 0.001% and 1% of an average value of the z-component of the main magnetic field at the average instability onset radius.

10. The synchrocyclotron according to claim 9, wherein the offset amplitude is between 0.005% and 0.05% of the average value of the z-component of the main magnetic field.

11. The synchrocyclotron according to claim 1, wherein the synchrocyclotron has a nominal energy of extraction, the low energy is between 20% and 75% of the nominal energy, and the high energy is between 80% and 100% of the nominal energy.

12. The synchrocyclotron according to claim 11, wherein the low energy is between 30% and 50% of the nominal energy.

13. The synchrocyclotron according to claim 11, wherein the high energy is between 90% and 99% of the nominal energy.

14. The synchrocyclotron according to claim 1, wherein the symmetry is an odd number.

15. They synchrocyclotron according to claim 14, wherein the symmetry is 3.

16. The synchrocyclotron according to claim 1, wherein the radial tune of successive orbits is comprised within 1±0.025.

17. The synchrocyclotron according to claim 1, wherein the radial tune of successive orbits is greater than 1.002 and less than 1.015.

18. A method for extracting charged particles out of a synchrocyclotron at an extraction energy between a low energy and a high energy, the method comprising the steps of:

providing a synchrocyclotron configured such that the charged particles reach the extraction energy at a corresponding average instability onset radius of an orbit between a low radius and a high radius, the average instability onset radius corresponding to respective average radial positions relative to a central axis of the charged particles at the low and high energies, wherein a radial tune of successive orbits is not equal to 1 and is within 1±0.1 for all values of an average radius between the low radius and the high radius;

selecting a value of the extraction energy of the charged particles to be extracted;

determining a value of an offset amplitude required for offsetting the center of an orbit of average radius of the charged particles at the extraction energy;

generating a resonance instability of the successive orbits of average radius greater than or equal to the average instability onset radius;

adjusting a magnitude of the field bump such that the amplitude of the field bump equals a value of an offset amplitude at the average instability onset radius and is lower than the values of the offset amplitude for all values of the average radius smaller than the average radius; and extracting a beam from the synchrocyclotron through an exit port.

19. The synchrocyclotron according to claim 18, wherein the radial tune of successive orbits is comprised within 1±0.025.

20. The synchrocyclotron according to claim 19, wherein the radial tune of successive orbits is greater than 1.002 and less than 1.015.

* * * * *